US005318180A

United States Patent [19]

Grigsby

[11] Patent Number: 5,318,180

[45] Date of Patent: Jun. 7, 1994

[54] WOOD-CLEATED CORRUGATED PAPERBOARD INSERT FOR LAWNMOWER CONTAINER

[75] Inventor: John M. Grigsby, Marietta, Ga.

[73] Assignee: North American Container Corporation, Mableton, Ga.

[21] Appl. No.: 882,346

[22] Filed: May 13, 1992

[51] Int. Cl.[5] ..... B65D 85/68

[52] U.S. Cl. ..... 206/335; 206/319; 206/497; 229/23 C

[58] Field of Search ..... 206/319, 320, 326, 335, 206/386, 497, 599, 600; 229/23 C; 217/43 A

[56] References Cited

U.S. PATENT DOCUMENTS

| | | | |
|---|---|---|---|
| 2,361,937 | 11/1944 | Gondert . | |
| 2,965,276 | 12/1960 | Foster . | |
| 3,136,472 | 6/1964 | Waller et al. . | |
| 3,583,626 | 6/1971 | Overton, III et al. | 229/23 C |
| 3,727,786 | 4/1973 | Fausel | 229/23 C X |
| 4,008,847 | 2/1977 | Davis | 206/45.14 X |
| 4,171,741 | 10/1979 | Fish . | |
| 4,230,227 | 10/1980 | Kowall et al. | 206/600 |
| 4,832,256 | 5/1989 | Grigsby . | |
| 4,852,756 | 8/1989 | Holladay | 206/335 |
| 5,069,338 | 12/1991 | Grigsby . | |

FOREIGN PATENT DOCUMENTS

| | | | |
|---|---|---|---|
| 1236617 | 6/1960 | France | 229/23 C |
| 1265313 | 5/1961 | France . | |

*Primary Examiner*—Bryon P. Gehman
*Attorney, Agent, or Firm*—Kennedy & Kennedy

[57] ABSTRACT

An insert having a central bottom panel with two end panels and two top flanges foldably connected by spaced-apart scores for forming a U-shape insert that is received by a conventional regular slotted container. A pair of elongate members attach to the bottom panel to provide increased bottom rigidity to the container. A pair of cleats attach to each of the side panels and a lower end of the cleat rests on an upper surface of one of the elongate members. A transverse member attaches to each top flange and is supported on an upper end of the cleats. The transverse member supports a top load on the container and the cleats communicate the top load to the elongate members. An enclosed container is disclosed for holding an article on the elongate members by wrapping the insert and the article thereon with a film.

19 Claims, 3 Drawing Sheets

WOOD-CLEATED CORRUGATED PAPERBOARD INSERT FOR LAWNMOWER CONTAINER

TECHNICAL FIELD

This invention relates generally to a corrugated paperboard container. More particularly, this invention relates to a wood-cleated corrugated paperboard insert that provides increased stacking and handling strength for a corrugated paperboard container for packing, shipping and storing articles.

BACKGROUND OF THE INVENTION

Packaging of moderately heavy, bulky articles such as walk-behind mowers, televisions, engines, microwaves, air conditioners and the like presents many unique considerations. Because of the competitive nature of the marketplace for similar such articles, it has long been recognized that a container must be a relatively low cost component of the price of the article. Often such articles are packed and stored in conventional corrugated paperboard containers. Braces of various types are inserted into the container between the article and the interior walls to hold the article in the container. For example, foam braces are often used to hold such articles within the container. Foam braces and other foam packing products, however, are not as readily recyclable as is corrugated paperboard, and, in some instances, such foam packing material may be more expensive than other materials used with conventional corrugated paperboard containers. Corrugated paperboard wedges and braces have been accordingly been developed for holding the article in the container.

The conventional corrugated paperboard container consists of a sheet-like blank having a plurality of scores that define foldable wall panels for the container body. A narrow flange called a manufacturer's joint foldably attaches along a score at one longitudinal end of the corrugated paperboard blank. The flange is secured to the opposite longitudinal end when the blank is folded along the scores to form the container body. The manufacturer's joint is secured with an adhesive such as polyvinyl alcohol (PVA) or the like. A series of top flaps foldably connect to the panels along a top and a bottom score. When the container is used, the bottom flaps are folded and secured together with adhesive, staples, or the like. The article to be contained is then placed in the container body with the various packing braces to hold the article in the container. The top flaps are then folded along their respective scores to close the open top of the container.

One known paperboard container is adapted for packaging a walk-behind self-propelled or manually-pushed mower. The container includes a bottom plate made from a sheet of corrugated paperboard. A pair of corrugated paperboard runners with foam pads are attached to the plate and disposed parallel to a longitudinal axis of the plate for receiving a lower edge of the cutter-deck of the walk-behind mower placed in the container. The paperboard runner is positioned so that the wheels of the container are between the runner and the wall of the container. A wedge-shape vertical member is formed from a sheet of corrugated paperboard. One such folded vertical member inserts into each corner of the container. A lower inside portion of the vertical members include a cut-out for the wheels, so that the vertical member extends between the bottom and the top of the container in an effort to provide vertical rigidity for strength to stack several of the containers one on top of another.

There are several problems with existing packs that contribute to unsatisfactory use for packing articles. To better utilize warehouse space for storage and trailer truck space for shipping articles in these containers, the containers often are stacked 8 or 10 high. The weight of the article contained therein may be as much as 150 pounds or more per container. This imposes a top load of up to 1,500 pounds on the bottom box. The plain corrugated paperboard container with die-cut verticals are affected by humidity and repeated handling of the containers in distribution centers. Increased humidity and handling weakens the paperboard in the container. Weakened paperboard lowers the stacking strength of the container and may result in the container collapsing while stored in a wavehouse stack or during stacked transit in trailers or rail cars.

Another problem arising from use of such containers is the handling strength of the container. While such containers often are grouped together on pallets for handling with a forklift, individual containers or stacks may be handled by either a forklift or clamp truck. Forklifts typically require that the container include an external skid board below the container base to provide clearance for the fork blades. In the absence of a skid board, the bottom flaps on the container and the bottom plate support the container on the forklift. The bottom of the paperboard container described above is not sufficiently strong to allow entry of the fork blade and lifting of several units at a time. The unsupported portions of the container would tend to bow inwardly under the load of a stack of containers, possibly damaging the article and collapsing the corners of the container. Yet another problem with forklifts is operator error. Even when acting with due care, the forklift operator may misdirect the fork blades and pierce the container, thereby causing damage not only to the container but to the product package therein.

For these and other reasons, clamp trucks are often preferred over forklift trucks for handling these containers. Clamp trucks are also known as squeeze trucks, and provide a pair of hydraulically activated arms having vertical platens that are placed against the side of the container to be handled. The platens apply a horizontal force against the container in order to lift and transport the container. The clamp pressure may range up to 1,500 pounds on the platens, and can result in collapse of the container and damage to the article. In the case where the article is a walk-behind mower, particular damage can occur to the wheels. Walk-behind mower wheels are relatively weak, and the wheels often are mounted with bolts attached to the mower blade housing for axles on which the wheels rotate. Excessive compression from a clamp truck, or collapse of a stack of containers, may cause the bolts to bend or "splay", resulting in damage to the wheels and to the mower. Even if the wheels or other parts of the mower are not damaged, the visual damage to the container itself is suggestive of damage to the article and consumers are less willing to purchase an article packed in a container with visible damage. Such container and article damage can also occur from rough handling of the container, such as drops or impacts with handling equipment during wavehouse handling and shipment of the containers. Such drops and impacts can also cause splaying of the wheels of a walk-behind mower.

Known corrugated paperboard containers for articles such as walk-behind mowers include a number of component parts that are assembled while packing an article. There are several problems associated with having a number of component parts. First, the component parts must be inventoried, which takes space for storage and time for monitoring the amount of each part in inventory and for re-ordering stock. Assembly of the container with a number of component parts, and packing of the article therein, is time consuming and labor intensive. The component parts must be delivered to the assembly line in a quantity sufficient to meet the production, and production scheduling must coordinate the correct component parts with the product being produced. The rate of production can be high which requires timely delivery of the component parts to the production line. For instance, the production line for some walk-behind power mowers could be 400 to 600 units per hour. Fewer component parts reduces the labor required for packing articles.

Thus, there is a need in the prior art for a corrugated paperboard container that addresses the problems of handling, storing and shipping articles packed therein.

SUMMARY OF THE PRESENT INVENTION

The present invention solves the above-described problems with corrugated paperboard containers by providing a wood-cleated corrugated paperboard insert for a corrugated paperboard container. Generally described, the present invention provides an insert for a corrugated container for packaging an article. The insert comprises a sheet having a plurality of scores to define a U-shape insert having a bottom panel, two end panels, and two top flanges. The insert is received within a corrugated container adjacent the bottom and the interior side walls thereof. A pair of spaced-apart elongate members attach to the bottom panel and are disposed parallel to a longitudinal axis thereof for receiving an article to be packaged in the container. A pair of cleats are attached to each end panel, and each cleat is in axial alignment with one of the elongate members attached to the bottom panel. A lower end of each cleat rests on an upper surface of a respective elongate member when the end panels are folded perpendicular to the bottom panel, to thereby provide stacking strength for the container. The top flanges are each foldably joined along a score to an edge of a separate one of the end panels. The top flange folds along the score and contacts an upper end of the pair of cleats attached to the respective end panel. A transverse member attaches to each top flange and is disposed perpendicular to the longitudinal axis of the sheet. The transverse member contacts the upper end of the cleats when the sheet is folded on the scores to form the U-shaped insert for a container.

The elongate members attached to the bottom panel provide rigidity and strength to the bottom of the corrugated paperboard container. The cleats attached to each end panel provide stacking strength to the container, particularly when used in conjunction with the transverse members on the top flaps. The top load imposed on the container is communicated between the top of the container and the elongate members in the bottom of the container by the vertical cleats. The elongate members and the vertical cleats increase the strength and rigidity of the container to withstand the rough handling during storing and shipping the container, as well as withstand the degradation of the paperboard due to humidity and warehouse handling. Finally, the insert of the present invention reduces the number of component parts required to assemble the container and to pack an article therein. This results in significant labor saving on the production line as well as inventory control savings.

More particularly described, the wood-cleated corrugated paperboard insert of the present invention provides a stand-along enclosure that does not require the use of a conventional container. The insert receives an article on the elongate members between the end panels, and a plastic film then is wrapped around the insert and the article as a closure. The cleats and the transverse members cooperate with the elongate members to provide a rigid frame for the wrapped insert, and the film encloses the article, thus eliminating the need to use a conventional slotted corrugated paperboard carton to enclose the article. More particularly described, each of the cleats in an alternate embodiment attach to a side flap foldably attached to an edge of a respective end panel. The side flap folds upwardly perpendicular to the end panel, thereby positioning the cleat on a side of the insert instead of on the end.

Thus, it is an object of the present invention to provide a wood-cleated corrugated paperboard insert for packaging articles in a container.

It is a further object of the present invention to provide a wood-cleated corrugated paperboard insert that increases the stacking strength of a container, so that multiple units thereof can be stacked for storing, handling, or shipping.

It is a further object of the present invention to provide a wood-cleated corrugated paperboard insert that increases the bottom rigidity of a container for handling and shipping.

It is a further object of the present invention to provide a wood-cleated corrugated paperboard insert that increases the side wall compression strength of a container for handling by clamp truck equipment.

It is a further object of the present invention to provide a wood-cleated corrugated paperboard insert that reduces the effort and time to pack an article in a container.

It is a further object of the present invention to provide a wood-cleated corrugated paperboard insert that decreases the number of component parts necessary to pack an article for storing and shipping in order to reduce inventory control problems.

It is a further object of the present invention to provide a wood-cleated corrugated paperboard insert that is less susceptible to the effects of humidity so that a container using the insert has a longer service life.

It is a further object of the present invention to provide a wood-cleated corrugated paperboard insert for a container that can withstand repeated handling in distribution channels for articles packed therein.

It is a further object of the present invention to provide a wood-cleated corrugated paperboard insert that increases the strength of a container and to resist damage to the article in the container.

It is a further object of the present invention to provide a container having a wood-cleated corrugated paperboard insert wrapped with a film to enclose an article on the insert.

These and other objects, features and advantages will become apparent from a reading of the following detailed description of the invention and claims in view of the appended drawings.

DETAILED DESCRIPTION OF THE PREFERRED EMBODIMENT

Figure 1:
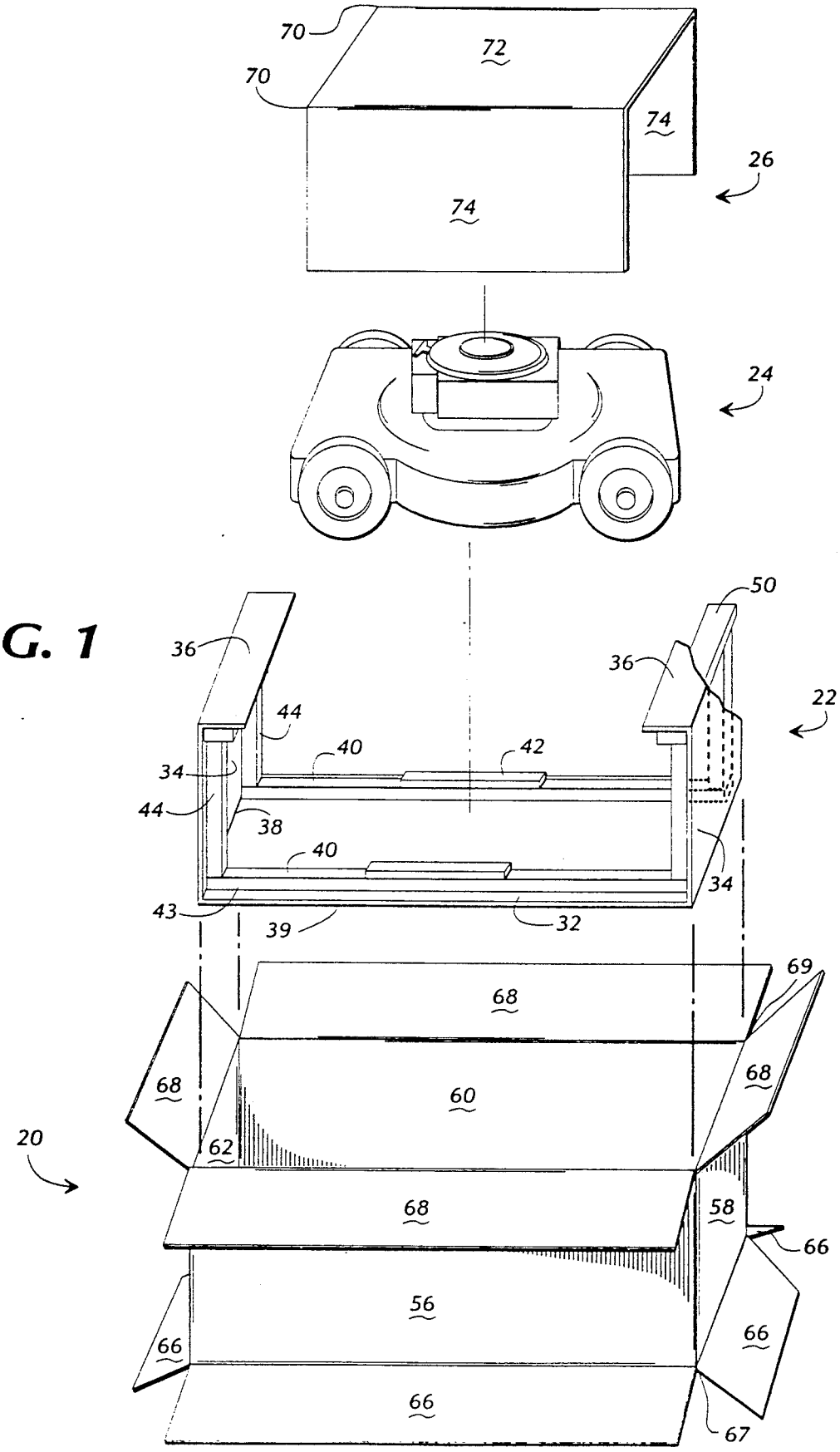
FIG. 1 is a perspective view of a preferred embodiment of a wood-cleated corrugated paperboard insert constructed in accordance with the present invention and exploded from a corrugated paperboard body that receives the insert.

Referring now in more detail to the drawings, in which like numerals indicate like parts throughout the several views, FIG. 1 shows a perspective view of a preferred embodiment of a wood-cleated corrugated paperboard insert 22 constructed in accordance with the present invention and exploded from a corrugated paperboard body 20 that receives the insert for packing an article in a container 23. A walk-behind lawn mower 24 is illustrated as the article to be packed in the container 23, with a corrugated paperboard sheet 26 forming a top cap for the container.

Figure 2:
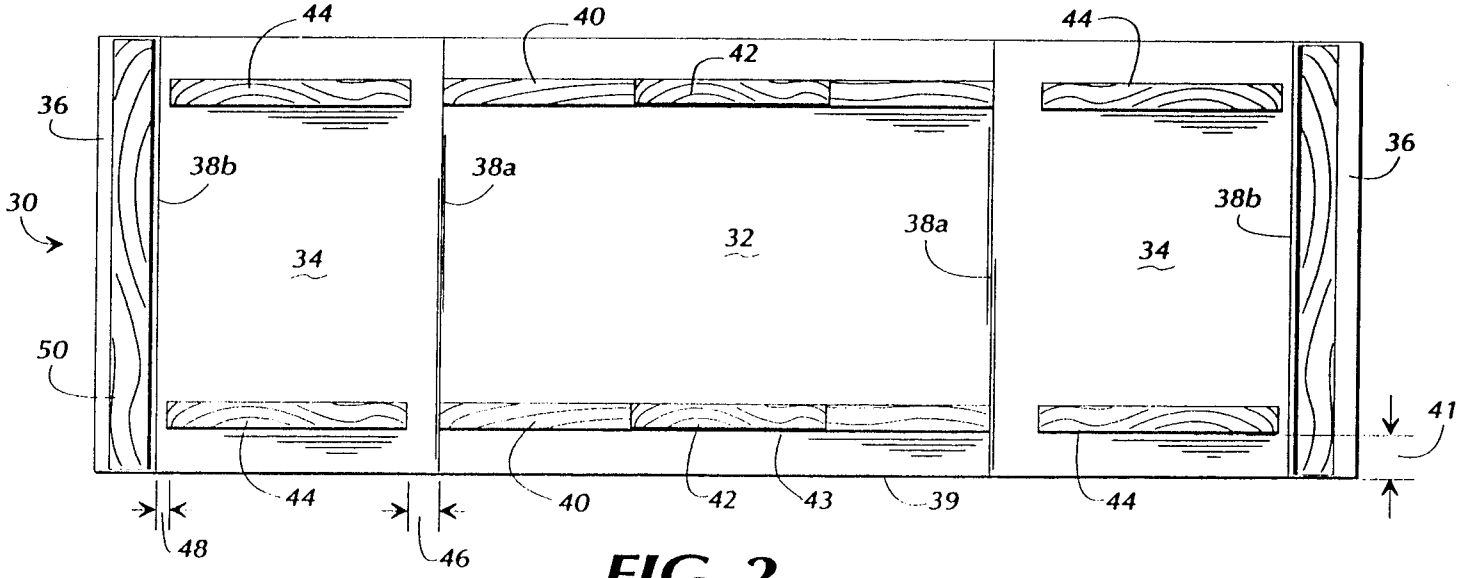
FIG. 2 is a top plan view of a corrugated paperboard blank for forming the insert illustrated in FIG. 1.

The wood-cleated corrugated paperboard insert 22 is shown in top plan view in FIG. 2. The insert 22 in the illustrated embodiment is formed from a blank 30 of sheet-like material. A preferred sheet-like material is corrugated paperboard, and the corrugations are preferably oriented transverse to the longitudinal axis of the blank 30. The blank 30 includes a bottom panel 32, two end panels 34, and two top flanges 36 foldably connected along four scores 38 in longitudinal alignment. The bottom panel 32 is centrally disposed with one of the end panels 34 on each of two opposing sides thereof. One of the top flanges 36 foldably attaches to an outward edge of each end panel.

A pair of elongate members 40 attach to the upper surface of the bottom panel 32 for increasing the bottom strength of the insert and thereby increasing the bottom strength of the container. The increased bottom strength facilitates the use of a forklift truck to handle or or more containers. The elongate members 40 are preferably made of a rigid material, such as a hard wood or similar material, including plastic wood, composite wood, and the like. The elongate members 40 are disposed parallel to a longitudinal axis of the blank 30 and are spaced inwardly from a side edge 39 of the bottom panel 32 to provide a gap 41 between a side face 43 of the elongate member 40 and the side edge. The elongate member 40 extends the full length of the bottom panel 32 between the scores 38*a* that define the bottom panel 32. In the illustrated embodiment, a support member 42 is rigidly attached to an upper surface of each of the elongate wood members 40. The support member 42 may be another wood member or a resilient pad, if necessary in consideration of the article to be supported thereon.

Each end panel 32 includes a pair of reinforcements or cleats 44 which provide top-load stacking strength for the corrugated paperboard body 20 when the insert 22 is received therein. The cleats 44 preferably are made of a hard wood or similar material. A pair of the cleats 44 are attached with adhesive and staples to each of the end panels 34, and each cleat is oriented in axial alignment with a respective one of the elongate members 40. Each of the cleats 44 are offset from the score 38*a* to define a gap 46 equal to the thickness of the elongate member 40. When the insert 22 is folded on the scores 38 as illustrated in FIG. 1, the lower end of each of the cleats 44 rests on an upper surface of the respective elongate member 40. There is a second gap 48 between the distal end of the cleat 44 and the score 38*b* that defines the end panels 34 and the top flange 36, for a purpose discussed below.

A transverse member 50 attaches to each of the top flanges 36. Each transverse member 50 is oriented perpendicular to the longitudinal axis of the blank 30, and the transverse member 50 extends between the side edges of the blank 30. The thickness of the transverse member 50 is equal to the gap 48 between the end of the cleat 44 and the score 38*b*. The transverse member 50 provides a top frame on the sides of the container which can support other containers that may be stacked thereon. The upper ends of the cleats 44 support the transverse member 50 and the top flange 36 when the insert 22 is folded on the scores 38 as illustrated in FIG. 1. The top load imposed on the transverse members 50, for example, by other containers stacked thereon, is communicated by the cleats 44 to the elongate members 40 in the bottom of the container.

The elongate members 40, the cleats 44, and the transverse members 50 are each secured to the surface of the corrugated paperboard blank 30 by an adhesive. A preferred adhesive known in the box industry is polyvinyl alcohol (PVA), and any suitable adhesive may be used. The elongate members 40, the cleats 44, and the transverse members 50 may also be stapled to the blank 30. The preferred staples have three-fourths inch to one inch crown and have a leg length equal to approximately the thickness of the member or cleat plus a thickness of the blank 30. It is furthermore preferred that the staples be spaced apart a distance of approximately four inches and angled at forty-five degrees to achieve maximum contact of the corrugated paperboard panels 32, 34 and 36 to the elongate member 40, the cleats 44, and the transverse member 50, respectively.

With reference to FIG. 1, the container 23 in the illustrated embodiment includes a corrugated paperboard body 20 preferably formed from a foldable blank of corrugated paperboard material. The container body 20 preferably is a conventional regular slotted carton known in the box industry. The blank includes four main wall panels 56, 58, 60 and 62 foldably connected along a plurality of spaced-apart scores 64. As shown in FIG. 1, the four main panels 56, 58, 60 and 62 form the four walls of the container body 20. A manufacturer's joint (not illustrated) is foldably connected to one of the main panels. The function of the joint is well-known to those skilled in the art for connecting the longitudinal ends of the paperboard blank together when forming the container body 20. In the illustrated embodiment, a series of four bottom flaps generally designated 68 are foldably connected to the main panels 56, 58, 60 and 62 along a bottom score 67. Similarly, a series of four top flaps generally designated 68 are foldably connected to the main panels along a top score 69. The bottom flap 66 and the top flaps 68 close the container 20 when it is used. The width of the bottom flaps 66 and the top flaps could differ, depending on whether the bottom and the top are fully closed or partially closed.

The top cap 26 illustrated in FIG. 1 is formed from sheet of paperboard material having scores 70 to define a top panel 72 and a pair of end panels 74. The top cap 26 covers the article, such as the lawn mower 24 which is supported on the elongate members 40 and the support members 42 of the insert 22. The end panels 74 slide downwardly between the lawn mower 24 (or other article enclosed in the container body 20) and the wall of the container body. The top panel 72 covers the top of the article, and can provide middle support for the top of the container, particularly if a smaller container is stacked on top or if the to flaps do not meet in the middle. In an alternate embodiment, the interior side of the top cap 26 is coated with a scuff-resistant material to reduce contact damage, such as scratching or wear, on the article in the container.

In the practice of the present invention, the blank 30 of corrugated paperboard shown in FIG. 2 is laid flat. The scores 38 are impressed in the blank 30 perpendicular to the longitudinal axis of the blank to define the bottom panel 32, the two end panels 34, and the top flange 36. The elongate members 40, the cleats 44 and the transverse member 50 are fully glued and stapled to the main panels as discussed above. The support member 42 is secured to the elongate members 40, if necessary. The cleats 44 on each end panel are spaced-apart from the scores 38 to provide the gaps 46 and 48. The insert 22 is then stacked with others for storage and subsequent transport to an assembly line for use. The insert 22 is then folded along the score lines 38 to form the insert into a U-shape. The insert is then received by an open ended container, such as the corrugated body 20 illustrated in FIG. 1.

The container body 20 illustrated in FIG. 1 is a conventional regular slotted carton that is assembled by folding the blank of corrugated paperboard along the scores 60 to form the wall panels 56, 58, 60 and 62. The walls of the container 20 are closed by joining the manufacturer's joint at one longitudinal end of the blank to the other longitudinal end, such as with adhesive. The bottom flaps 66 are folded and rigidly connected together with an adhesive, and staples if necessary.

The folded insert 22 having a U-shape is then positioned in the container 20 with the bottom panel 32 against the inside surfaces of the bottom flaps 36. The end panels 34 are positioned against the wall panels 58 and 62. The article to be packaged in the container, such as the lawn mower 24, is then placed on top of the elongate members 40, and the supports 42 if used. Preferably, the bottom edge of the housing of the lawn mower 24 rests on the elongate supports 40. The wheels of the lawn mower 24 are in the gap 41 between the side face of the elongate member 40 and the edge of the bottom panel 32. The thickness of the elongate members 40 (and the support 42, if used) preferably is sufficient to space a bottom edge of the wheel away from the interior surface of the bottom panel 32. Spacing the wheel apart from the panel 32 reduces the potential for damage to the wheel and the axle that could be caused by dropping the container or by other rough handling.

A foam pad (not illustrated) with an adhesive back is stuck on the top of the engine of the walk-behind mower 24. The top cap 26 is then placed over the engine, with the side panels 74 against the interior wall of the container body 20. The top flaps 68 are folded over and connected with adhesive or staples to close the container 23 and hold the mower 24 in the container. Other devices, such as screws or straps, could e used to hold an article on the elongate members 40 of the insert 22.

The wood-cleated corrugated paperboard insert provides a container body 20 with increased bottom strength, increased top load support and stacking strength, and increased sidewall compression strength for clamp truck handling. The elongate members 40 allow a forklift blade to extend under the container in order to pick-up and move the container. The members 40 extend the full length of the container body 20 and reduce the tendency of the container to bow when it is held on the blades of a forklift truck. The transverse members 50 provide a top frame for supporting other containers stacked thereon. Top loads created by stacking containers one on top of another are transmitted from the transverse members 50 by the cleats 44 to the elongate members 40 in the bottom of the container. The elongate members 40 and the transverse members 50 extend the full length and width, respectively, of the insert 22 to position the longitudinal end faces thereof against the interior surfaces of the container body 20. The members 40 and 50 permit the container 23 to be picked up with a clamp truck, with the platens positioned against the exterior side walls 56 and 60, or with the platens positioned against the side walls 58 and 62. The platens effectively press against the end faces of the members 40 and 50 which have sufficient strength to withstand the horizontal force imposed on the container by the clamp truck.

As discussed above, the lawn mower 24 is packaged with a reduced number of components over prior art containers. The insert 22 particularly eliminates the separate folded verticals while reducing the time and effort required to assemble the container 23 and to pack an article on the production line. The insert 22 is preferably received flat from a manufacturer and during the packing process is folded on the scores 38 to form the U-shape for the insert 22 to be received in a container for packing an an article.

Figure 4:
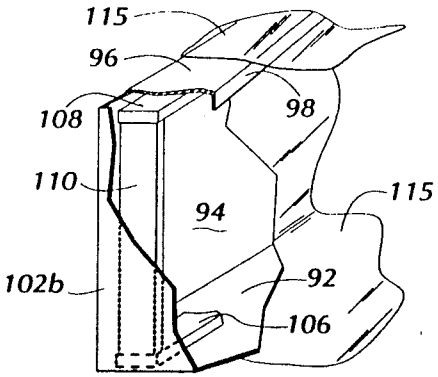
FIG. 4 is a perspective cut-away view of the alternate embodiment of the insert illustrated in FIG. 3, folded into a U-shape.
Figure 3:
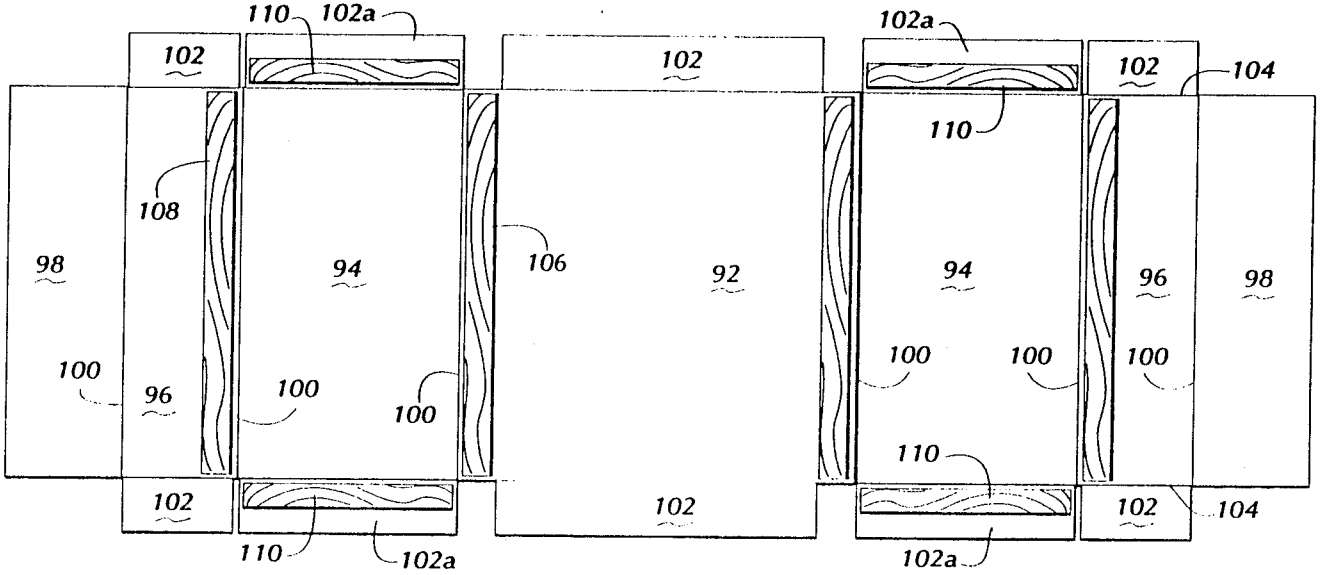
FIG. 3 is a top plan view of an alternate embodiment of a blank for forming an insert constructed in accordance with the present invention.

FIG. 3 is an alternate embodiment of the insert 22, illustrated in top plan view, and FIG. 4 is a perspective cut-away view of the alternate embodiment folded for inserting into a container body 20. In this alternate embodiment, a blank 90 of corrugated paperboard includes a bottom panel 92, a pair of end panels 94, a pair of top flanges 96, and a pair of top flaps 98 foldably connected along scores 100. A plurality of side flaps generally designated 102 are foldably joined to opposing edges of the blank 90 along a respective score 104. The side flaps 102 fold perpendicular to the respective panel 92, 94 or 96 when the blank 90 is folded to form the U-shape for the insert for receiving by the container body 20. The side flaps 102 are then positioned against the interior walls of the container body 20 to provide additional side strength to the container.

The blank 90 further includes a plurality of wood or wood-like cleats that provide the bottom, the stacking and the top load reinforcement for the container in which the insert is placed. A pair of elongate members 106 are glued and stapled to the bottom panel 92, as discussed above. In this alternate embodiment, each of the elongate members 106 are positioned perpendicular to a longitudinal axis of the blank 90 and near one of the scores 100 between the bottom panel 92 and the end panel 94. The top flange 96 further receives a transverse member 108 which is glued or stapled thereto, as discussed above. Each of the transverse members 106 is positioned perpendicular to the longitudinal axis of the blank 90, parallel to the elongate members 106. A cleat 110 is glued and stapled to each of the side flaps 102*a* attached to the end panels 94. The cleat 110 communicates the top load from the transverse member 108 to the elongate members 106 on the bottom panel 92, as discussed above with respect to the insert 22 shown in FIG. 1. However, in the embodiment shown in FIG. 3, the cleats 110 are on the side flap 102 that is positioned against a side wall of the container instead of being positioned against an end wall of the container. The side flap 102*a* accordingly is folded perpendicular to the end panel 94 when the blank 90 is folded on the scores 100 to form the substantially U-shaped insert.

An article such as the lawn mower 24 is then placed on the elongate members 106. The article is then secured to the insert 22 by wrapping the article and the insert with a plastic film 115 as best illustrated in FIG. 4. In an alternate embodiment, the article and the insert are enclosed with a heat-shrinkable film or bag and then passed through a heat tunnel. As illustrated in FIG. 4, the wrapped insert can be used as a stand-alone container for the lawn mower 24 or other article. Clear plastic wrapping enables a "see-through" container. The top flap 98 provides additional rigidity to the frame-like enclosure shown in FIG. 4, and the top flap 98 could be eliminated if the insert is used with a conventional container as discussed above.

Figure 5:
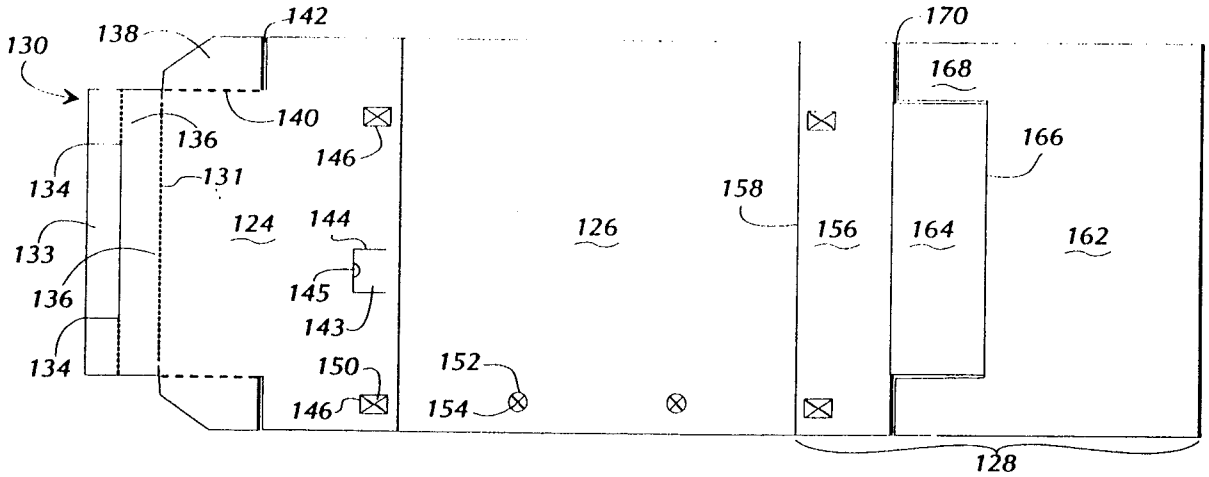
FIG. 5 is a top plan view of a cover pad for the container illustrated in FIG. 1.

FIG. 5 illustrates a top plan view of a die-cut parts pad 120 which can be used with the wood-cleated corrugated paperboard insert of the present invention instead of the top cap 26. The parts pad 120 is configured to hold the handle of the lawn mower 24, a grass catcher and bag, and the other parts for the lawn mower 24. The specific features (openings and flaps) of the parts pad differ depending upon the size and the shape of the handle and the grass catcher for the particular walk-behind lawn mower 24 to be packed.

In the illustrated embodiment, the parts pad 120 is die-cut from a blank 122 of corrugated paperboard. A plurality of scores in the parts pad 120 define a front panel 124, a top panel 126, and a rear panel generally designated 128. The front panel 124 includes a flange 130 foldably joined thereto by a first perforated score 131. In the illustrated embodiment, the flange 130 is narrower than the width of the parts pad 120. The flange 130 includes a foldable notch 132 along an outside edge. The flange 130 is defined by slots 134 that extend parallel to the longitudinal axis of the parts pad from the outside edge inwardly to a second perforated score 136 parallel to the perforated score 131. The second perforated score 136 is about half-way between the edge of the flange 130 and the perforated score 131. A pair of side flaps 138 are defined by a perforated score 140 and a slot 142 cut from a side edge inwardly towards the longitudinal axis of the parts pad 120.

A tab 143 is formed in the front panel 124 adjacent the score 150 between the front panel 124 and the top panel 126. The notch 132 locks the parts pad 120 to the insert 22. The tab 143 is formed by three slits cut in a U-shape, and the tab folds along a line between the distal ends of the two side slits. The tab 130 extends upwardly through a handle of the grass catcher placed on top of the parts pad 120, as discussed below. A semi-circular finger opening 145 is cut in a leading edge of the tab 143 so that the tab may be pulled upwardly from the front panel 124. A pair of rectangular punch openings 146 are formed in the front panel 124 and each includes two crossed slits 150 that define an X-shaped cutout therein. The tubes of the handle for the mower are received through the slits 150 in the openings 148.

The top panel 126 includes a pair of circle punch openings 152 adjacent a side edge of the parts pad 120 for receiving a flange on the handle of the mower. The openings 152 include star-burst slits 154 which are cross-shaped in appearance. The flanges of the handle punch through the openings 152 to secure the handle to the top panel 126.

The rear panel 128 has a first portion 156 defined by foldable scores 158 and 160. A second pair of rectangular punch openings 148 for receiving the tubular handle of the mower are formed in the first portion 156 with the cross-shaped slits for receiving the handle therethrough. The rear panel 128 further has a side portion 162 foldably connected to an intermediate portion 164 by a score 166. The side portion 162 includes two arms 168 defined by L-shaped slots 170. The parts pad 120 is positioned in the container 20 after the lawn mower 24 is placed on the insert 22 in the container. The tubes of the handle for the lawn mower pass through the openings 148 in the front panel 124 and the first portion 156 of the rear panel 128. The parts pad 120 is then placed in the upper portion of the container 20 on top of the lawn mower. The foldable notch 132 is folded for inserting between the cleats 44 on the end panel to lock the parts pad 120 to the insert 22. The tab 143 is pulled upwardly and the front panel 124 angles upwardly from a low position in the container body 20 towards the lawn mower 24. The top panel 126 rests on and covers the top of the lawn mower 24. The flaps 138 fold upwardly inside the tubes of the lawn mower handle. The tubes of the handle extend longitudinally across a bottom surface of the top panel 126 and through the openings 148 in the first portion 156 of the rear panel 128. The rear side 164 folds downwardly and inserts towards the bottom of the container 20 with the arms 168 adjacent the cleats 44. The grass catcher and the handle fit into the die-cut parts pad 120 with the other components and parts of the lawn mower. In an preferred embodiment, the parts pad 120 is coated with an abrasive resistant material to prevent paint abrasion of the parts.

The specification has thus described various embodiments, including a preferred embodiment, of the present invention, and including the steps necessary for fabricating such embodiments. It is to be understood, however, that numerous changes and variations may be made in the construction of the present invention of a wood-cleated corrugated paperboard insert for a container. It should therefore be further understood that modifications of the present invention may be made without departing from the scope thereof as set forth in the appended claims.

What is claimed is:

1. An insert for a corrugated container for packaging an article, comprising:

a sheet having a plurality of scores to define a bottom panel, two end panels, and two top flanges;

a pair of spaced-apart elongate members attached to the bottom panel and each member having a pair of distal ends;

a pair of spaced-apart elongate cleats attached to each end panel, each cleat in axial alignment with a respective one of the elongate members and each cleat having a first end and a second end; and a transverse member attached to each top flange and oriented perpendicular to each of the elongate members wherein the sheet, being folded on the scores so that the top flanges are perpendicular to the respective end panel and parallel to the bottom panel, defines a substantially U-shaped insert for being received by a container, the first end of each cleat contacting the respective elongate member at the respective distal end, the second end of each cleat contacting the respective transverse member.

2. The insert as recited in claim 1, wherein the sheet is corrugated paperboard.

3. The insert as recited in claim 1, wherein the elongate members, the cleats, and the transverse members are made of a rigid material.

4. The insert as recited in claim 1, wherein the elongate members, the cleats, and the transverse members are wood.

5. The insert as recited in claim 1, wherein the elongate members extend the length of the bottom panel.

6. The insert as recited in claim 1, wherein the elongate members are spaced inwardly from a side edge of the bottom panel, thereby defining a gap between a side face of the respective elongate member and the side edge.

7. The insert as recited in claim 6, further comprising a pair of support members, each attached to and longitudinally aligned with a respective one of the elongate members for supporting a lawnmower having a pair of wheels on each of two sides such that the wheels are disposed in the gap and spaced from the bottom panel.

8. The insert as recited in claim 1, wherein each of the cleats is disposed on the respective end panel to define a first gap between the first end and the score between the bottom panel and the respective end panel, the length of the first gap equal to the thickness of the respective elongate member.

9. The insert as recited in claim 8, wherein each of the cleats is disposed on the respective end panel to define a second gap between the second end and the score between the end panel and the respective top flange, the length of the second gap equal to the thickness of the respective transverse member.

10. A container for an article, comprising:

a sheet having scores to define a bottom panel and two end panels folded on the scores to a form a U-shape;

a pair of spaced-apart elongate members attached to the bottom panel of the sheet;

a pair of spaced-apart cleats attached to each end panel, each cleat disposed so that a first end of each cleat contacts the respective elongate member;

a top flange foldably joined along a score to an end edge of each end panel, the top flange folded inwardly perpendicular to its respective end panel parallel to the bottom panel;

a transverse member attached to each top flange and oriented perpendicular to each of the elongate members whereby a second end of each cleat contacts a transverse member;

an article supported on the elongate members; and a film wrapped around the folded sheet to enclose the article.

11. The container as recited in claim 10, wherein the sheet is corrugated paperboard.

12. The container as recited in claim 10, wherein the elongate members, the cleats, and the transverse members are made of a rigid material.

13. The container as recited in claim 10, wherein the elongate members, the cleats, and the transverse members are wood.

14. The container as recited in claim 10, wherein the elongate members are spaced inwardly from a side edge of the bottom panel, thereby defining a gap between a side face of the respective elongate member and the side edge.

15. The container as recited in claim 14, wherein the article is a lawnmower with a pair of wheels on each of two sides; and further comprising a pair of support members, each attached to and longitudinally aligned with a respective one of the elongate members for supporting the lawnmower such that the wheels are disposed in the gap and spaced from the bottom panel.

16. The container as recited in claim 10, wherein each of the cleats is disposed on the respective end panel to define a first gap between the first end and the score between the bottom panel and the respective end panel, the length of the first gap equal to the thickness of the respective elongate member.

17. The container as recited in claim 16, wherein each of the cleats is disposed on the respective end panel to define a second gap between the second end and the score between the end panel and the respective top flange, the length of the second gap equal to the thickness of the respective transverse member.

18. A container for holding a lawnmower, comprising:

a corrugated paperboard body; and an insert received within the body, comprising:

a sheet having a plurality of scores to define a bottom panel, two end panels, and two top flanges;

a pair of spaced-apart elongate members attached to the bottom panel and each member having a pair of distal ends;

a pair of spaced-apart cleats attached to each end panel, each cleat aligned with a respective one of the elongate members and having a first end and a second end; and a transverse member attached to each top flange and oriented perpendicular to each of the elongate members, wherein the sheet, being folded on the scores, defines the insert having a substantially U-shape received by the body, the first end of each cleat contacting the respective member at the respective distal end, the second end of each cleat contacting the respective transverse member;

whereby a lawnmower, being placed on the elongate members, is held in the container.

19. The container as recited in claim 18, wherein:

the lawnmower has a pair of wheels on each of two sides; and the elongate members are spaced inwardly from a side edge of the bottom panel, thereby defining a gap between a side face of the respective elongate member and the side edge, whereby the elongate members support the lawnmower with the wheels disposed in the gap and spaced from the bottom panel.

* * * * *